US005299808A

United States Patent [19]

Wood

[11] Patent Number: 5,299,808

[45] Date of Patent: Apr. 5, 1994

[54] BOARD GAME APPARATUS

[76] Inventor: Ethel M. Wood, 9724 Springfield Woods Cir., Glen Allen, Va. 23060

[21] Appl. No.: 983,032

[22] Filed: Nov. 30, 1992

[51] Int. Cl.[5] ..... A63F 3/00

[52] U.S. Cl. ..... 273/243; 273/285

[58] Field of Search ..... 273/242, 243, 285, 256, 273/278; 103/59, 63, 64, 65, 67, 99, 111, 115

[56] References Cited

U.S. PATENT DOCUMENTS

| | | | |
|---|---|---|---|
| 2,284,242 | 5/1942 | Ziemmerman | 273/285 |
| 2,774,599 | 12/1956 | Dunn | 273/285 X |
| 3,458,216 | 7/1969 | Harrison | 273/285 X |
| 3,730,528 | 5/1973 | Corrado | 273/285 X |
| 3,995,704 | 12/1976 | Blickman | 273/285 X |
| 4,012,046 | 3/1977 | Liket | 273/243 |
| 4,205,851 | 6/1980 | Hopkins | 273/285 X |
| 4,279,422 | 7/1981 | Shaw | 273/243 X |

*Primary Examiner*—William Stoll

*Attorney, Agent, or Firm*—Leon Gilden

[57] ABSTRACT

A board game apparatus is provided, wherein utilizing a die member, tokens associated with each player are directed about a continuous game path, with the game path arranged to assimilate trials and experiences relative to life relative to alcohol, drugs, and the like and provide for direction relative to expenses regarding school, family expenses, etc. A player is awarded an initial dollar total, with movement about the game path requiring receiving and spending of various dollar amounts.

1 Claim, 8 Drawing Sheets

FIG. 1
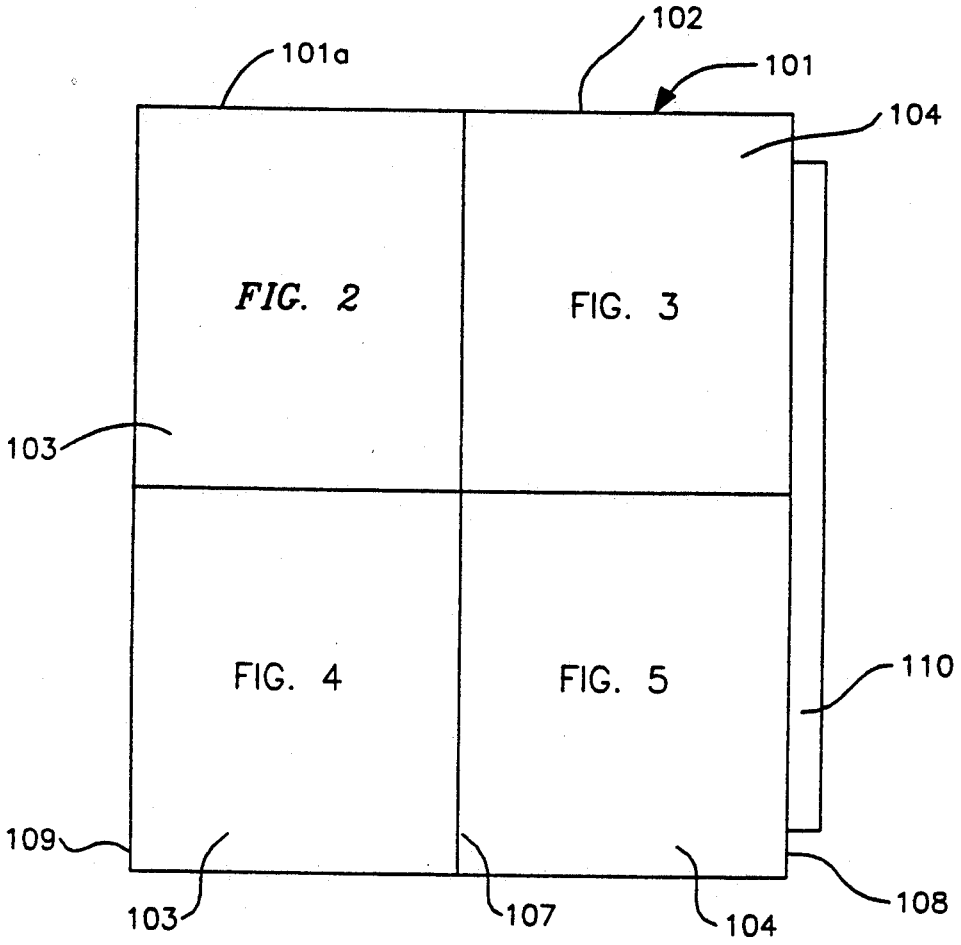
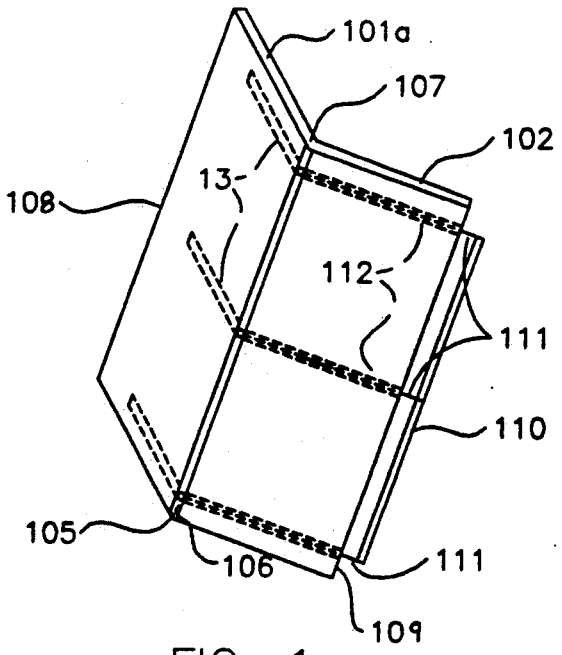
FIG. 1a

BOARD GAME APPARATUS

BACKGROUND OF THE INVENTION

1. Field of the Invention

The field of invention relates to board game apparatus, and more particularly pertains to a new and improved board game apparatus wherein the same is arranged to simulate experiences and trials relative to life experiences for educational and entertainment purposes.

2. Description of the Prior Art

Board games of various types have been available in the prior art to simulate various experiences such as exemplified in U.S. Pat. No. 5,007,650 arranged to simulate experiences in a collegiate social life style.

U.S. Pat. No. 4,842,281 to Turner sets forth a board game utilizing various monetary awards or penalties and various chance spaces.

U.S. Pat. No. 4,962,934 to Taylor sets forth a further game apparatus for simulating life experiences utilizing various shortcuts arranged within the game path.

As such, it may be appreciated there continues to be a need for a new and improved game board apparatus as set forth by the instant invention which addresses both the problems of ease of use as well as effectiveness in construction in providing individual players with various experiences to simulate the broad range of life-style experiences and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same utilizes the game of chance and associated tokens and monetary awards to permit movement about a game path. As such, the general purpose of the present invention, which will be described subsequently in greater detail, is to provide a new and improved board game apparatus which has all the advantages of the prior art board game apparatus and none of the disadvantages.

To attain this, the present invention provides a board game apparatus wherein utilizing a die member, tokens associated with each player are directed about a continuous game path, with the game path arranged to assimilate trials and experiences relative to life and relative to alcohol, drugs, and the like and provide for direction relative to expenses regarding school, family expenses, etc. A player is awarded an initial dollar total, with movement about the game path requiring receiving and spending of various dollar amounts.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic top view of the game board configuration of the invention.

FIG. 1*a* is an isometric illustration of the game board in an unlocked configuration arranged for folding thereof.

DESCRIPTION OF THE PREFERRED EMBODIMENT

Figure 2:
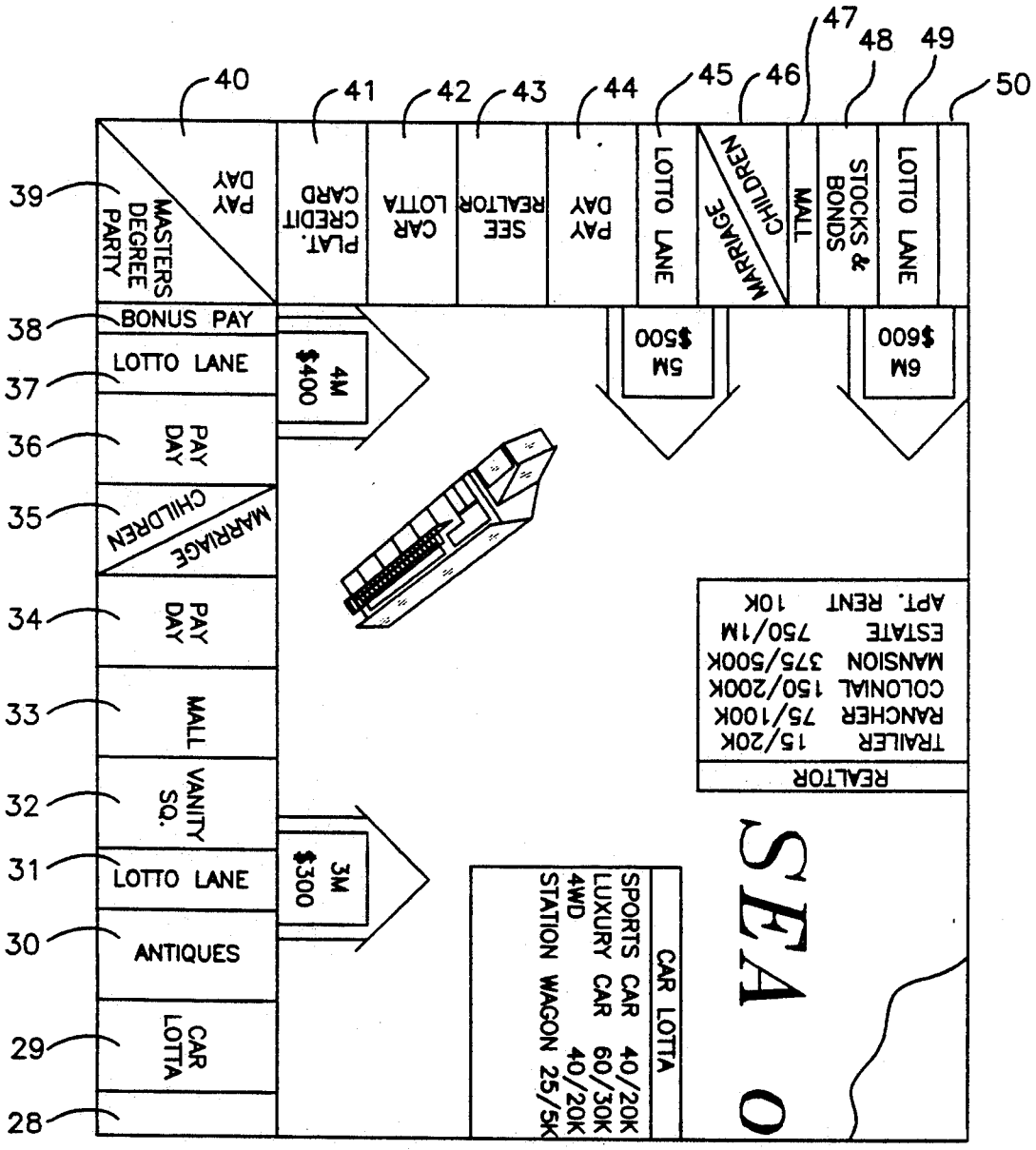
FIG. 2 is an orthographic view of section 2 as set forth in FIG. 1.
Figure 3:
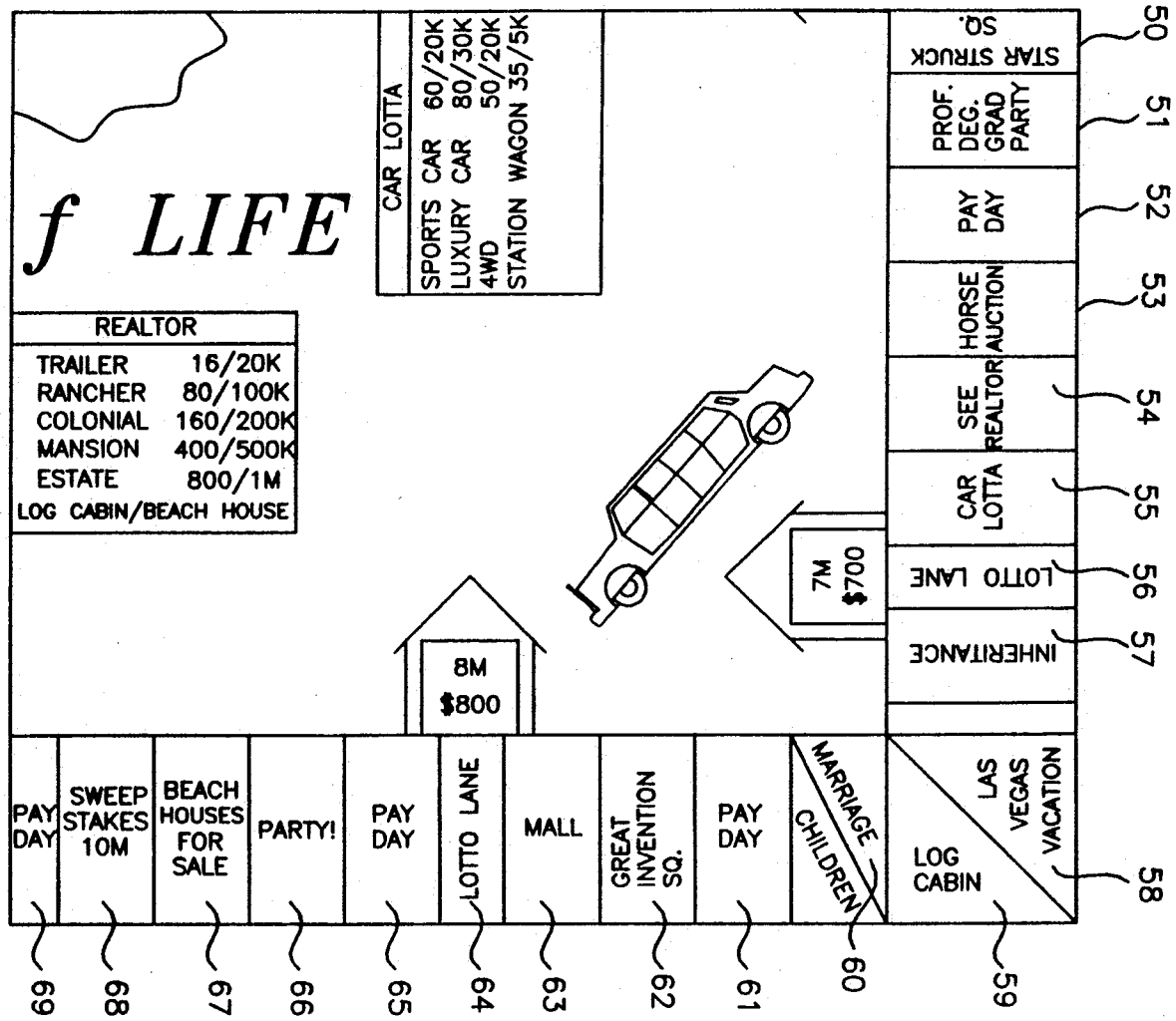
FIG. 3 is an orthographic view of section 3 as set forth in FIG. 1.

With reference now to the drawings, and in particular to FIGS. 1 to 40 thereof, a new and improved board game apparatus embodying the principles and concepts of the present invention and generally designated by the reference numerals 1–113 will be described.

Figure 7:
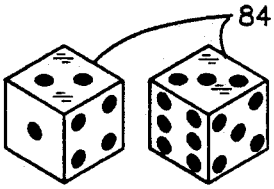
FIG. 7 is an isometric illustration of the dice members.
Figure 8:
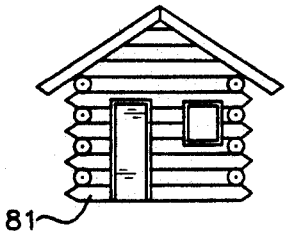
FIGS. 8–21 are isometric illustrations of various token configurations utilized in the invention.
Figure 9:
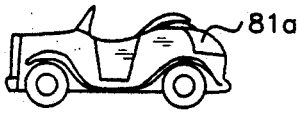
Figure 10:
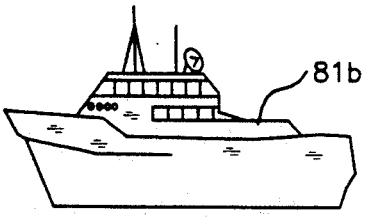
Figure 11:
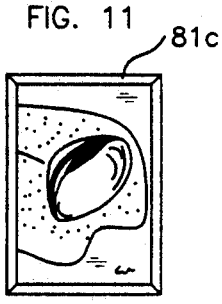
Figure 12:
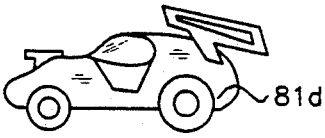
Figure 13:
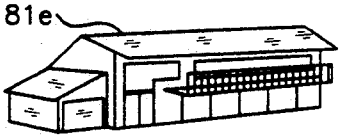
Figure 14:
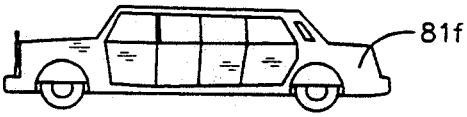
Figure 15:
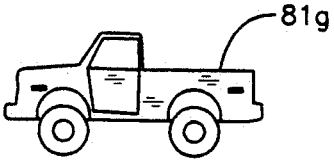
Figure 16:
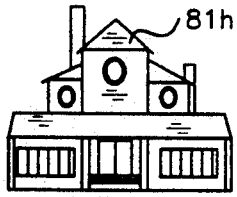
Figure 17:
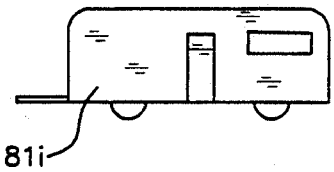
Figure 18:
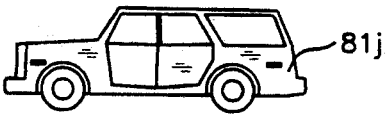
Figure 19:
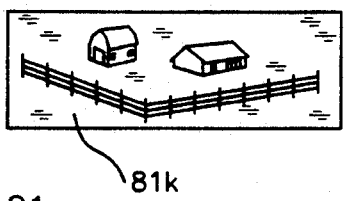
Figure 20:
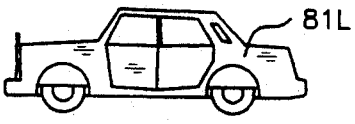
Figure 21:
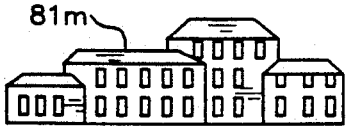
Figure 22:
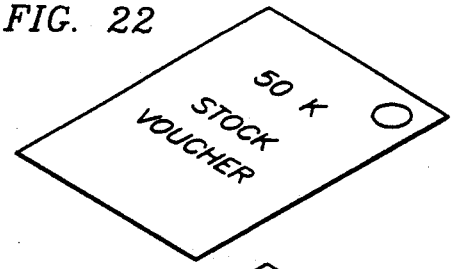
FIGS. 22–40 are isometric illustrations of various documents that may be employed in play of the game of the invention.
Figure 23:
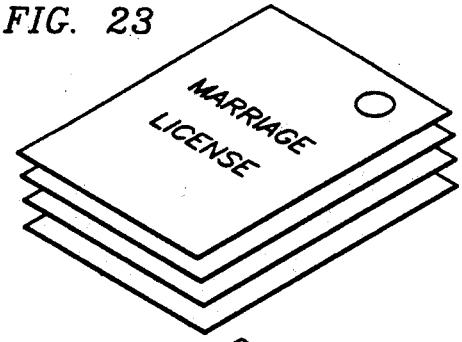
Figure 24:
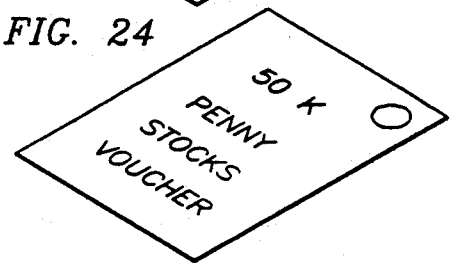
Figure 25:
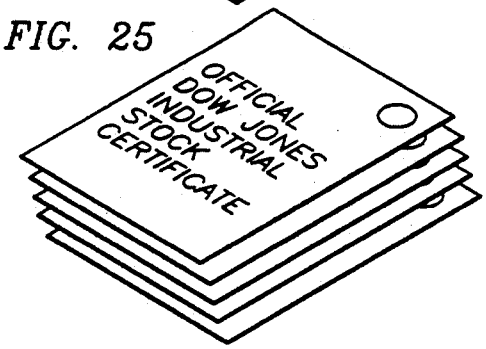

More specifically, the board game apparatus of the invention essentially comprises a game board 101 having a continuous perimeter path directed thereabout of the spaces 1–80, as marked and indicated in the FIGS. 2–5. Play is initiated at space number 1 indicated as the mall, where each player is initially provided with five thousand dollars cash and a blue credit card, such as indicated in the FIG. 33, having a five thousand dollar credit limit with no cash advances available. To vacate the mall space 1, each player must pay one hundred dollars to leave. Space 2 indicated as the party space, wherein each player is to throw the dice pair 84, as indicated in FIG. 7, wherein a rolling of a total six, except for a double three, indicates an unwanted pregnancy, or alcohol abuse if a double three is thrown, or drug abuse if a double six is thrown. The unplanned pregnancy cost is to lose three turns or an unwanted wedding with a cost of two thousand dollars. The childbirth is three thousand dollars in the unwanted pregnancy for a total of five thousand dollars, or wait three turns and pay no money and do not get married with the child going to adoption, with re-entry of the game at the next space. Alcohol rehabilitation cost five thousand dollars to a player or the loss of two turns, with drug rehabilitation costing ten thousand dollars or the loss of three turns in order to attempt to be directed to the next space of space three or high school. At the high school, the individual must throw the dice. A total of six indicates a failure of a course and an attendant five hundred dollars cost to a player for a tutor, wherein a throwing of double three indicates player embarrassment relative to the senior prom, wherein the prom dress or tuxedo are wasted and a payment of a thousand dollars or a rolling of sixes, an illness and to accommodate missing of classes and payment of the doctor bills, two thousand dollars is to paid, or the player may miss three turns. Space four is a mall space and a player must pay one hundred dollars to leave. Five is the equivalent of the high school gradation party, where a throwing of a dice in associated risk is availed, wherein an unwanted pregnancy is derived from a throwing of six on the dice, with a cost of two thousand dollars and the associated childbirth cost of three thousand dollars. A player may opt to pay no money, not get married, and lose three turns, with the child going for adoption. The throwing of double three to double sixes is indicated in a similar manner relative to the space 2. Space 6 is a paycheck of twenty-five thousand dollars for graduating high school or five thousand dollar scholarship for college. Space 7 is an optional marriage, wherein the option is to marry another high school graduate to double the paycheck relative to space 6, plus five thousand dollars in wedding gifts. Space 8 is a vacation, wherein cost is five hundred dollars and a player must throw the dice, wherein multiply the total thrown by the dice by ten to pay to the banker, wherein a banker is designated to maintain the money flow relative to the individual players. A throwing of double one for a total of two permits a player in turn to win ten thousand dollars. Space 9 relative to housing, wherein the cost is twenty-five percent of the value directed to the property at the end of the game. A trailer is five thousand dollars, wherein the value at the end of the game is twenty thousand dollars as an example. A rancher is twenty-five thousand dollars, a colonial home is fifty thousand dollars, a mansion is hundred twenty-five thousand dollars, and an estate is two hundred thousand dollars. To buy such property, a payment of ten percent down and balance to be paid at the end of the game or pay ten thousand dollars for apartment rent is availed for each player. Space 10 is the music space wherein a thousand dollars is paid for music lessons, with a throw of the dice a payment of seven is derived from the dice 84, you are awarded a music career and an equivalent of five million dollars. Space 11 is a lottery space, with a million dollars available, wherein a player pays one hundred dollars to the bank, one dice member is thrown and if a one is thrown, that player will win million dollars from the bank. Space 12 is a paycheck space and if working, one thousand dollars is provided or if in college, one thousand dollars is sent from the parents by way of the bank. Space 13 is an auction space, wherein a painting worth five thousand dollars is available, with bidding starting at one thousand dollars cash or charge. Space 14 is a car space and if a car is needed and you are married, you must have at least a two seater, and if one child is in the marriage, at least a three seater because room is required. Cars awarded are as such, "jalopy"—provided free from parents at no value at the end of the game; "sports car"—twenty thousand dollars value with ten thousand dollars value at the end of the game with two seats; "luxury car"—thirty thousand dollars, value fifteen thousand dollars at the end of the game with three seats; "four-wheel drive"—thirty thousand dollars value, fifteen thousand at the end of the game, with three seats; and "station wagon"—twenty thousand dollars value, five thousand dollars at the end of the game, and if the player has more than two children from the marriage spaces, a station wagon is mandatory. Space 15 is the paycheck to be awarded one thousand dollars. Space 16 is the penny stocks space, with an investment of five hundred dollars cash or credit, and such card as indicated in FIG. 24 is worth five thousand dollars at the end of the game. Space 17 like space 1 and the spaces 33, 47, 63, 73, and 77 each require the payment of one hundred dollars to the bank of the game for exiting that space. The spaces 18 like the space 2, as well as the space 25 and space 66, are similar characteristic and consequence relative to the utilization of the pregnancy, alcoholism, and drug addiction relative to rolling of the dice members 84. By contrast, the house party 24 relative to the space 24 is of similar but of varying consequence wherein a rolling of six by the dice members 84 requires a payment of a thousand dollars to the bank, rolling a double three requires the directing to summer school and payment of two thousand dollars, wherein the rolling of double six means breaking of engagement and losing a five thousand dollar engagement ring or missing one turn as an alternative.

Figure 35:
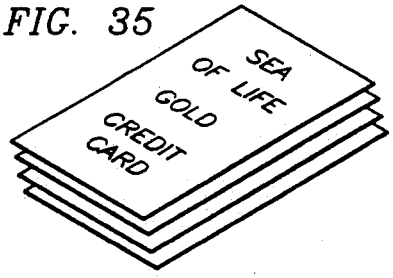
Figure 36:
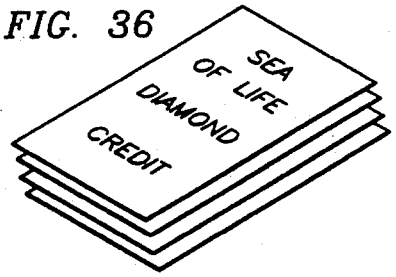
Figure 37:
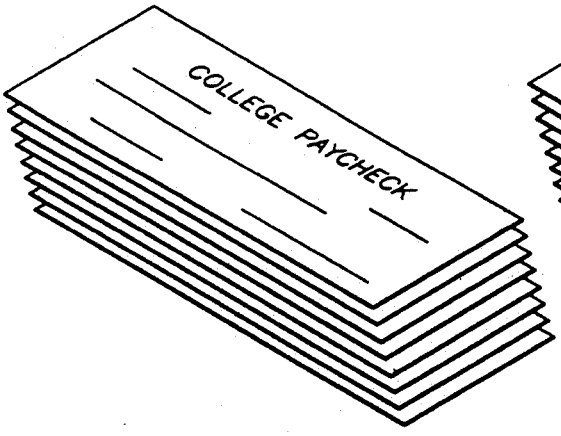
Figure 38:
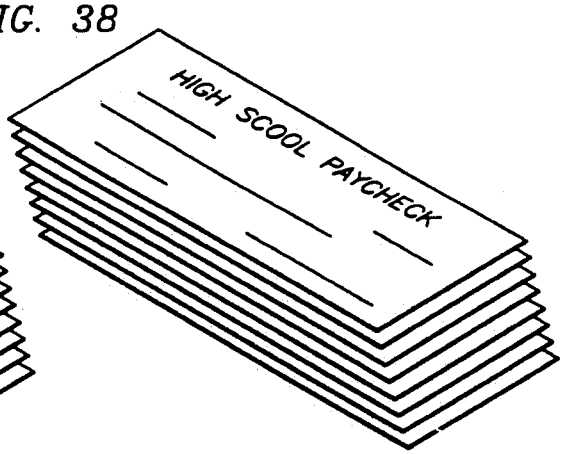
Figure 39:
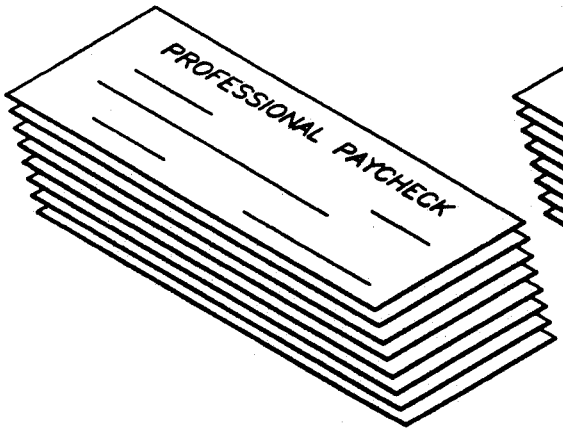
Figure 40:
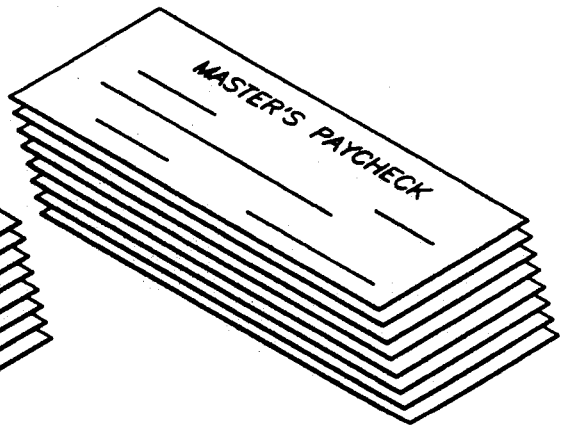

Space 19 permits the access to a gold credit card, as indicated by FIG. 35, requiring payment of the blue credit card bill in full in cash to obtain a gold credit card with a five hundred thousand dollar limit, with a thousand dollar bonus at the end of the game, with cash advances of one hundred dollars requiring payment of two hundred dollars. Space 20 is relative to a marriage space, with the spaces 35, 46, and 60, wherein high school graduates may only marry other high school graduates or educational equivalents, where payment from the spaces 12, 15, 26, 34, 36, 44, 52, 61, 65, and 69 as well as the space 76 relative to the retirement have been doubled. The space 76 for example has a bid of a variance relative to the pay spaces permitting the receiving of all retirement funds and checks that have been held in abeyance and saved by the players. Further, in the accepting of marriage through the space 20, a five thousand dollar bonus as a wedding gift is directed. Space 21 as a spring break directed to college students or participants enrolled in a college-type program, wherein the dice is thrown for a total of six resulting in an unwanted pregnancy requiring payment of two thousand dollars for a shotgun wedding or three thousand dollars for a childbirth. The rolling of double threes in this space results in alcohol abuse and five thousand dollars for rehabilitation or a loss of two turns, or the rolling of a double six for drug abuse, with ten thousand dollar rehabilitation and loss of three turns. The space 22 as a lottery space, as well as the spaces 31, 37, 45, 49, 56, 64, and 71, wherein upon payment of a predetermined fee such as two hundred dollars, the dice are thrown and upon rolling of two by the dice 84, two million dollars is achieved. Space 27 with an auction auto space, a vehicle valued at twice the purchase price is achieved, with the bidding to start at fifty thousand dollars cash or charge, with vehicles valued as directed in space 14. To achieve access to a further vehicle, the spaces such as the spaces 29 and 55 permit the purchasing of a vehicle, with vehicle spacing to provide for seating for children, as indicated relative to space 14, with relative values of a fractional percentage to be determined, such as thirty percent for example at the end of the game. For example, the acquisition of a sports car having two seats for two individuals such as a married couple without children may be purchased for forty thousand dollars, with a value of twenty thousand dollars at the end of the game. Space 30 permits acquisition of antiques, whereupon payment of five hundred dollars directs antiques to be valued at five thousand dollars at the end of the game, with cash only to be paid and not acquired through credit card lines of credit.

Figure 26:
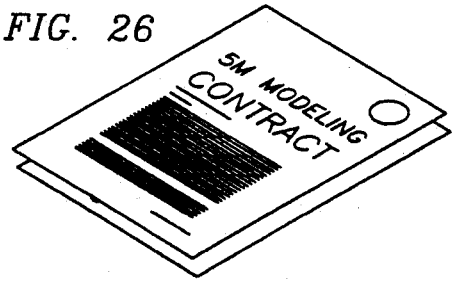
Figure 27:
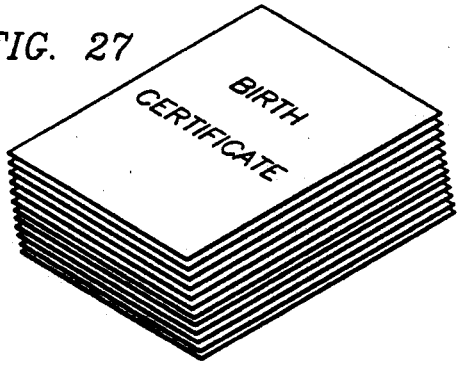
Figure 28:
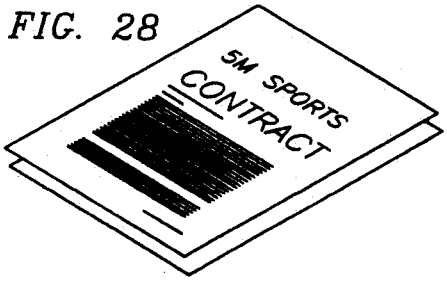
Figure 29:
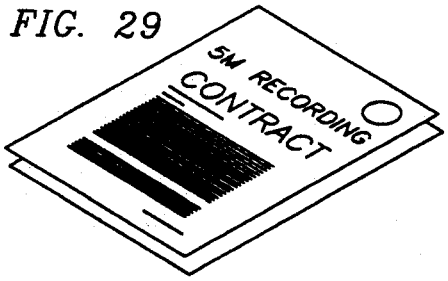
Figure 30:
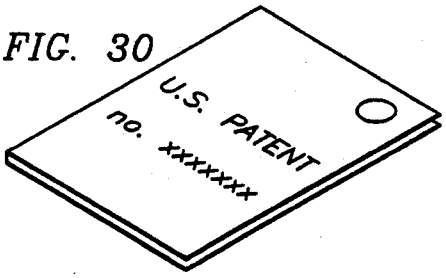
Figure 31:
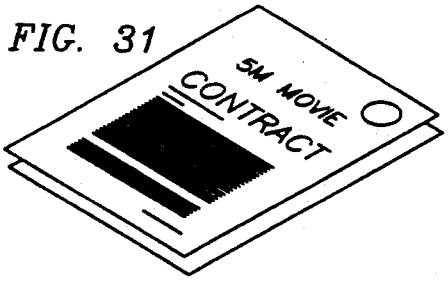
Figure 32:
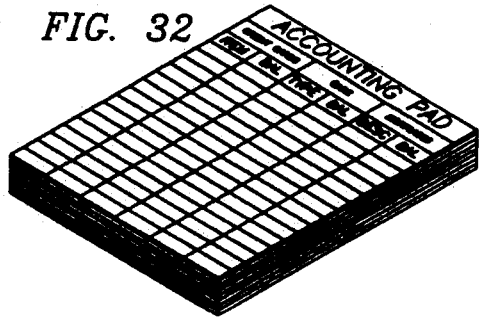
Figure 33:
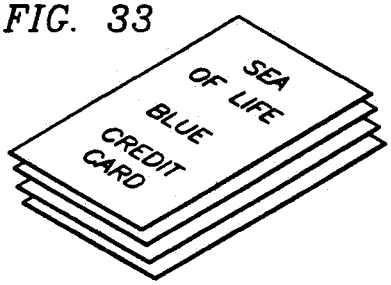
Figure 34:
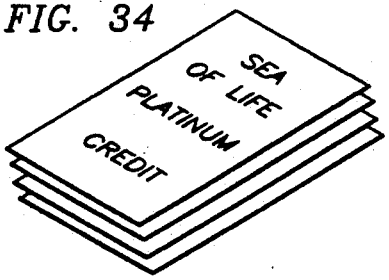

Space 32 indicated as a vanity space permits a thousand dollar purchase for a photo portfolio, with any combination of seven relative to throwing of the dice 84 achieves acquisition of a modeling contract worth five million dollars, as indicated in FIG. 26.

The spaces 7, 8, 9, and 40 are indicated of the payment vouchers directed to each player depending upon that player's level of educational achievement in playing of the game relative to the various pay spaces, such as space 12 for example.

Figure 4:
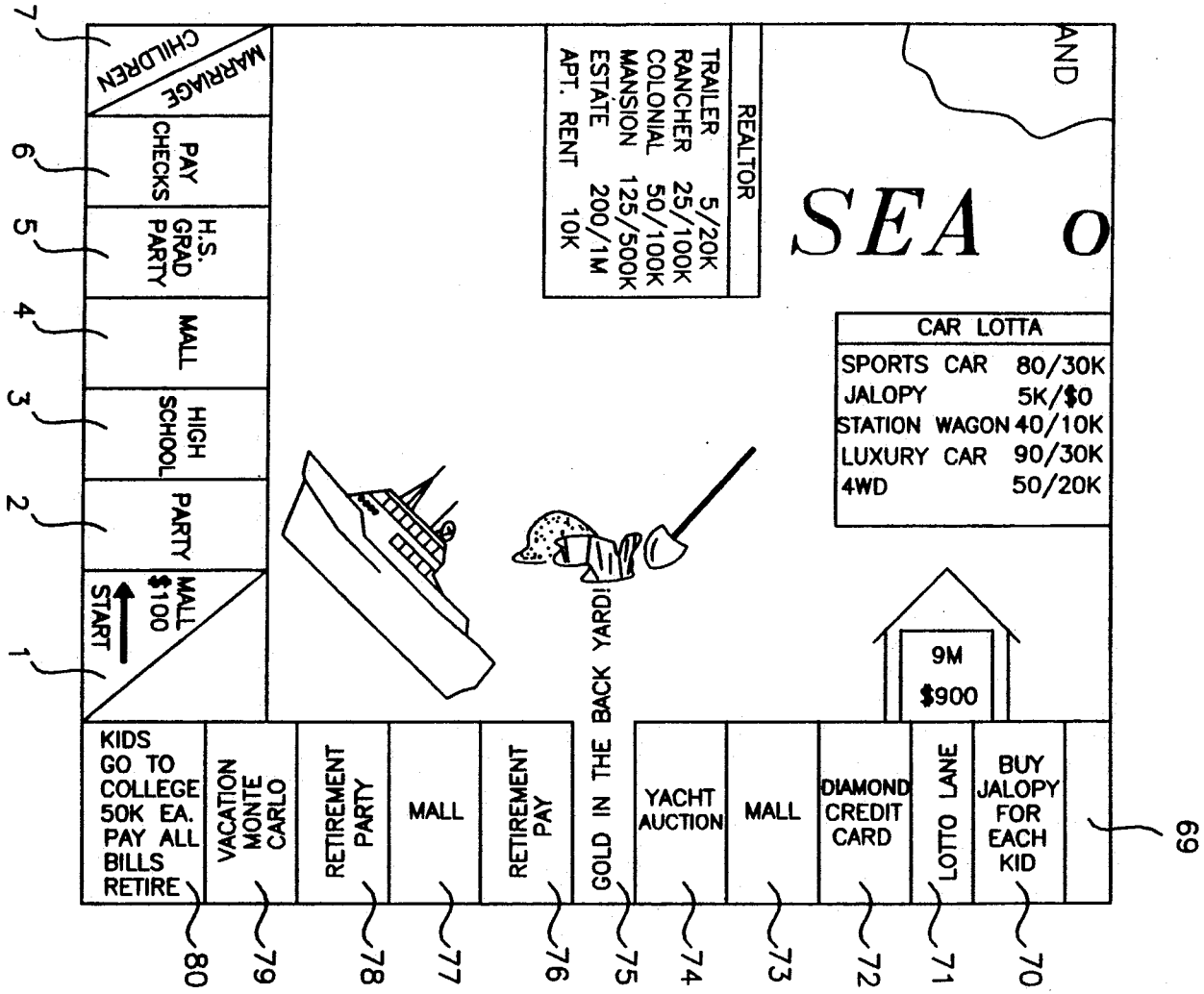
FIG. 4 is an orthographic view of section 4 as set forth in FIG. 1.
Figure 5:
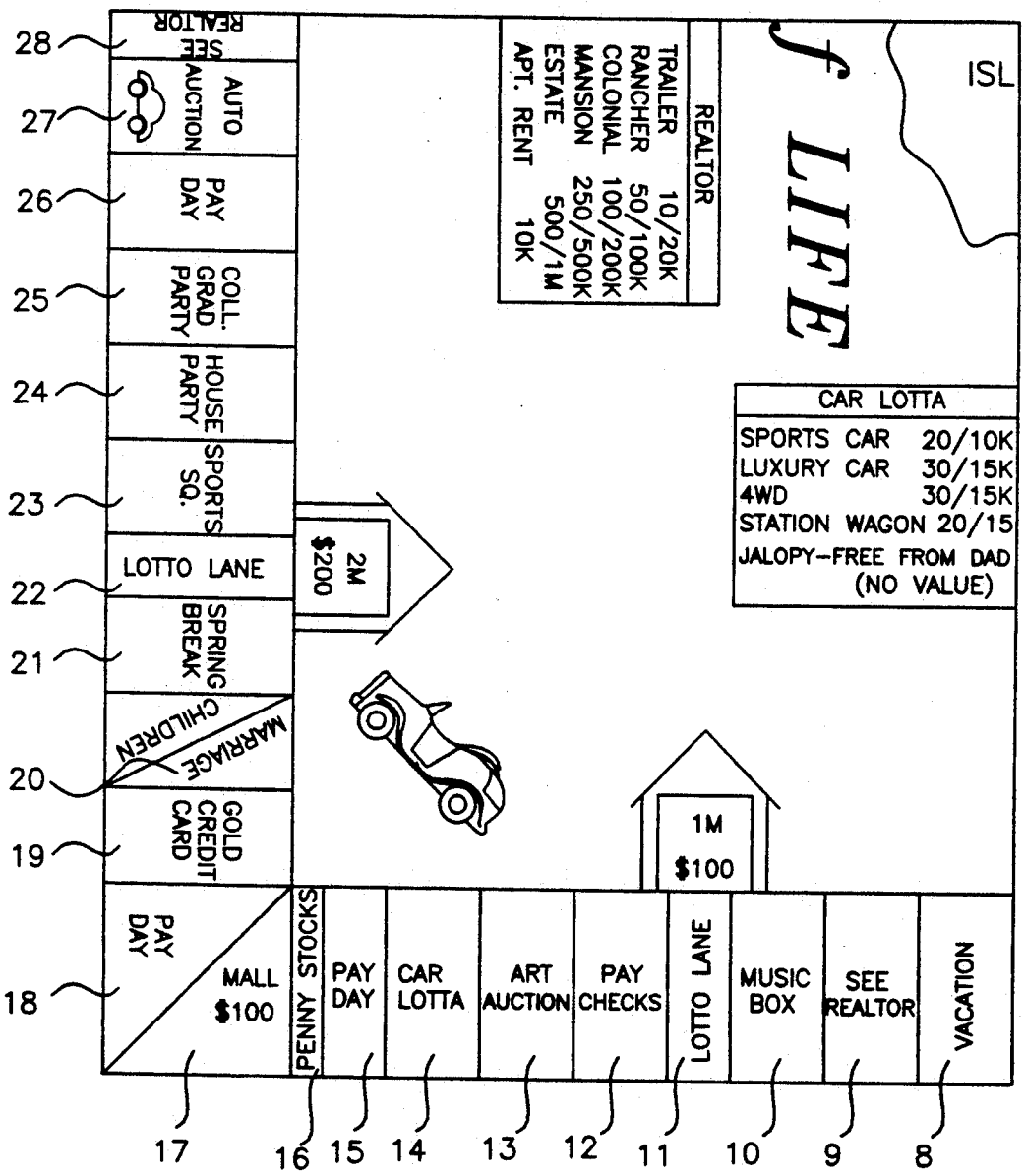
FIG. 5 is an orthographic view of section 5 as set forth in FIG. 1.
Figure 6:
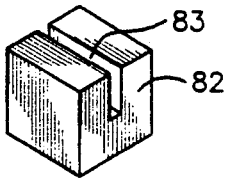
FIG. 6 is an isometric illustration of a card holder member of the invention.

It should be noted that in the marriage/children spaces, such as space 5, to obtain a child, throwing of the dice with any odd number directs acquistion of a boy, with an even number a girl, and a rolling of double indicators upon the dice such as snake-eyes, i.e. 2, achieves twins. For planned children, five thousand dollars in gifts is obtained from the bank. The paycheck spaces, such as the spaces 6 and 8, provides for various predetermined levels from the bank relative to earning, such as one thousand dollars and multiples thereof relative to the achievement of high school graduation, college education, and graduate school achievement. Space 41 permits attainment of a platinum credit card, such as indicated in FIG. 4, wherein requiring payment of the gold credit card in full with seven hundred fifty thousand dollar credit limit, five thousand dollar bonus at the end of the game for having maintained good credit, with cash advances for one hundred dollars to be paid in two hundred dollar increments per each hundred dollars borrowed.

Spaces such as the space 4 relative to housing and real estate purchases indicates the purchase of a trailer for fifteen thousand dollars, with a value at the end of the game of twenty thousand dollars, a rancher at seventy five thousand dollars, with a value of one hundred thousand dollars at the end of the game, a colonial at one hundred fifty thousand dollars, with a value of two hundred at the end of the game, a mansion at three hundred seventy-five thousand dollars, with a value of five hundred thousand dollars at the end of the game, with an estate being seven hundred fifty thousand dollars, valued at one million at the end of the game permitting purchase with ten percent down and balance at the end of the game, or ten thousand dollars for rent, in a manner as indicated such as relative to space 9 for example. The purchase of stocks and bonds per the FIG. 25 as an example requires an investment of ten thousand dollars, with a game value at the end of the game of fifty thousand dollars, such as indicated in space 48.

It should be noted that in all of the investment spaces and lottery spaces all such members are subject to arbitrary changing and relative values within the parameters of the guidelines of the game, such as investments being valued at a greater number at the game's end, as well as housing values and the like.

Space 50 relative to a star-struck square, wherein a thousand dollar investment relative to a screen test in any combination of throwing of seven obtains a five million dollar contract, as indicated and provided in FIG. 1. Spaces such as space 5 relative to the thoroughbred auction race, the race horse is valued at one million dollars to the highest bidder, with bidding beginning at one hundred thousand dollars among the players. Space 54 relative to housing costs is similar to that as set forth in space 4, wherein spaces such as space 59 relative to log cabin spaces and purchase permits a fifty thousand dollar purchase with ten percent down and balance at the end of the game, with value at the end of the game at one hundred thousand dollars. Space 57 relative to inheritance, if the player graduates high school, for example, he gets two times his salary; if the player happens to be married, he gets two times his and two times his spouse's salary, wherein the earnings as a player makes one complete round of the board of the path directs twice his yearly salary, or twice the yearly salary of his household if married, attained through the paycheck spaces such as space 6 for example. Space 62 notes that one thousand dollars invested may be valued at two million dollars upon rolling of a combination totaling seven, wherein such notation is exemplified per FIG. 0 of awarding of a U.S. patent. Space 67 relative to beach houses permits purchase of such a house of one hundred thousand, with value at two hundred thousand at the end of the game, with a typical ten percent down and balance to be paid at the end of the game. The sweepstakes space 68, wherein upon rolling of the dice with attaining of six or less, five million dollar sweepstakes is won, with attaining of seven or more directing an adopted child through earlier play of the game put up for adoption having found the player to award the biological child fifty thousand dollars for the child's college education. Space 70 indicates the jalopy space, with each child developed by that player through marriage and the like being awarded five thousand dollars by that player. Space 72 directs for a diamond credit card, such as per FIG. 6, with a ten thousand dollar bonus at the end of the game for good credit, with a million dollar line of credit and cash advances of one hundred dollars payable back at two hundred dollar increments. The space 54 relative to the auction is of a yacht auction worth one million dollars directed to the highest bidder. The space 75 permits rolling of the dice 84, where attaining a six or less awards twenty million dollars, with seven or more and effecting divorce and winnings divided by two at the end of the game. The retirement party per space 78 directs the rolling of the dice 84 for a total of three of a short illness and fifty thousand dollars medical expense, with a total of six of a greater medical problem effecting a ten thousand dollar rehabilitation cost, with a double three effecting a long illness, with one hundred thousand dollar medical costs. Space 39 relative to the vacation space directs payment of five thousand dollars plus throwing of the dice. The attaining of the dice 84 and total effected by the dice requires multiplying the total by one thousand and paying the banker unless a throwing of a double one for a total of two, wherein one hundred thousand dollars is won by that player. Space 80 relative to children in college requires payment of fifty thousand dollars for each child's college education, five thousand for each car (jalopy) for each child, and all credit card bills are due, as well as the mortgages attained through the various real estate purchases during game play.

For convenience in maintaining the game board 101 in a coplanar orientation, the game board 101 is formed of a first board 101*a* hingedly mounted to a second board 102 about a hinge web 107. The first board 101*a* includes a first board top surface 103 and the second board having a second board top surface 104. The first board top surface and the second board top surface are arranged in a coplanar relationship in a first position and oriented at an oblique orientation relative to one another in a second position, such as indicated in FIG. 1*a*. The first board having a first board interior side 105 spaced from and parallel a first board exterior side 109, with the second board having a second board interior side 106 in confronting relationship relative to the first board interior side 105, with the second board interior side 106 spaced from and parallel a second board exterior side 108. A slide bar 110 is reciprocatably mounted relative to the first board exterior side 108, with the slide bar 110 having a plurality of parallel lock rods 111 having a lock rod predetermined length, wherein the first board and the second board are each of a predetermined width less than the predetermined length. The first board having a plurality of spaced first conduits 112, each receiving one of the lock rods 111, with the second board having second conduits 113 directed into the second board and coaxially aligned with the first conduits when the first board and the second board are in the first position. The lock rods thereby are directed through the first conduits 112 and received within the second conduits 113 in the first position to maintain the game board 101 in a locked orientation in the first position, having the first board top surface and the second board top surface arranged in a coplanar relationship.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus, comprising, a game board, the game board having a continuous game path, having the game path formed of a plurality of contiguous spaces, some of the spaces include instructions to direct players to obtain or lose various predetermined quantities of dollar denominations, the game including a dice pair for directing movement about the path and the spaces, and, the spaces including a real estate category for obtaining real estate, a vehicular category for attaining automobiles, an education category for directing attainment of various levels of education, a marriage category for attaining a marriage partner and children, a pay category for attaining systematic awards of monetary value, and a credit category for providing a player of a plurality of players a predetermined level of monetary credit, and a plurality of tokens, wherein one of said tokens is awarded each player of a plurality of players for positioning the tokens along the path, and, the game board includes a first board and a second board, with the first board including a first board top surface and a second board including a second board top surface, wherein the first board top surface and the second board top surface are pivotal relative to one another, and a hinge web mounted between the first board and the second board permitting pivoting of the first board relative to the second board from a first position orienting the first board top surface in a coplanar relationship relative to the second board top surface, to a second position orienting the first board relative to the second board at an oblique angle, and the first board having a first board interior side and the second board having a second board interior side, wherein the first board interior side and the second board interior side are each arranged adjacent relative to one another, with the hinge web overlapping the first board interior side and the second board interior side, and, the first board includes a first board exterior side spaced from and parallel the first board interior side, and the first board includes a slide bar mounted to reciprocate relative to the first board exterior side, the slide bar having a plurality of lock rods, the lock rods orthogonally oriented relative to the slide bar and the first board having a plurality of lock bar first conduits, wherein each of the first conduits receives one of said lock rods, and the first board having a predetermined width and each of the lock rods having a lock rod length greater than the predetermined width, and the second board having a plurality of second conduits, with each of said second conduits arranged for receiving one of said lock rods, and the second conduits are coaxially aligned with the first conduits in the first position to receive the lock rods in the second conduits to secure the first board relative to the second board.

* * * * *